US011214052B2

(12) United States Patent
Berthon et al.

(10) Patent No.: US 11,214,052 B2
(45) Date of Patent: Jan. 4, 2022

(54) DEVICE AND PRINTING PRESS FOR PRODUCING A SECURITY ELEMENT ON A SUBSTRATE

(71) Applicant: KOENIG & BAUER AG, Würzburg (DE)

(72) Inventors: Aurélie Berthon, Villars-Sous-Yens (CH); Martin Palme, Kist (DE); Emmanuel Thony, Rennaz (CH)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/277,066

(22) PCT Filed: Sep. 26, 2019

(86) PCT No.: PCT/EP2019/076088

§ 371 (c)(1),
(2) Date: Mar. 17, 2021

(87) PCT Pub. No.: WO2020/094291

PCT Pub. Date: May 14, 2020

(65) Prior Publication Data

US 2021/0316545 A1 Oct. 14, 2021

(30) Foreign Application Priority Data

Nov. 8, 2018 (DE) ..... 10 2018 127 936.1

(51) Int. Cl.
*B41F 11/02* (2006.01)
*B42D 25/369* (2014.01)
(Continued)

(52) U.S. Cl.
CPC ..... *B41F 11/02* (2013.01); *B41F 13/08* (2013.01); *B41F 23/0443* (2013.01); *B42D 25/369* (2014.10); *B42D 25/41* (2014.10)

(58) Field of Classification Search
CPC ..... B41F 11/02; B41F 13/08; B41F 23/0443; B42D 25/369; B42D 25/41
See application file for complete search history.

(56) References Cited

U.S. PATENT DOCUMENTS

2010/0170408 A1* 7/2010 Gygi ..... B41F 23/00 101/116
2011/0017081 A1 1/2011 Gygi
(Continued)

FOREIGN PATENT DOCUMENTS

CH 105034570 B 10/2017
DE 102016204549 A1 9/2017
(Continued)

OTHER PUBLICATIONS

International Search Report of PCT/EP2019/076088 dated Jan. 21, 2020.

*Primary Examiner* — David H Banh
(74) *Attorney, Agent, or Firm* — Mattingly & Malur, PC

(57) ABSTRACT

The invention relates to a device for producing security elements (03) on a substrate (02), said device having a first printing couple (21; 22), by means of which substrate (02) being conveyed along a transport path is and/or can be printed with a plurality of first print image elements (12) spaced apart from one another using a first coating medium (11) that contains magnetic particles; a first magnetic cylinder (41), arranged downstream of the first printing couple (21; 22) in the transport path and comprising magnetic elements (43) on its outer circumference; a second magnetic cylinder (42), arranged downstream of the first magnetic cylinder (41) in the transport path and likewise comprising magnetic elements (43) on its outer circumference; and a drying and/or curing device (52), associated with or positioned downstream of the second magnetic cylinder (42) in the transport path, by means of which at least the coating
(Continued)

medium (13) of a plurality of second print image elements (14), printed onto the substrate (02) and spaced apart from one another, is and/or can be dried and/or cured at least superficially and/or at least each partially, wherein in the transport path between the first and the second magnetic cylinder (41; 42) a second printing couple (31; 32) is provided, by means of which the substrate (02) is and/or can be printed with the spaced-apart second print image elements (14; 12) using the second coating medium (13) that contains magnetic particles, and wherein a drying and/or curing device (51) positioned upstream of the second printing couple (31; 32) is associated with or positioned downstream of the first magnetic cylinder (41) in the transport path, by means of which device the coating medium (11) containing magnetic particles of the first print image elements (12) printed by the first printing couple (21; 22) is and/or can be dried and/or cured at least superficially and/or at least each partially.

15 Claims, 8 Drawing Sheets

(51) Int. Cl.

| | |
|---|---|
| ***B42D 25/41*** | (2014.01) |
| ***B41F 13/08*** | (2006.01) |
| ***B41F 23/04*** | (2006.01) |

(56) References Cited

U.S. PATENT DOCUMENTS

| | | | | |
|---|---|---|---|---|
| 2012/0205905 | A1* | 8/2012 | Degott | B42D 25/24 283/72 |
| 2017/0190197 | A1* | 7/2017 | Schaede | B41M 3/148 |
| 2018/0043679 | A1* | 2/2018 | Franz | B41F 11/02 |

FOREIGN PATENT DOCUMENTS

| | | | | | |
|---|---|---|---|---|---|
| EP | 2433798 | A1 | | 3/2012 | |
| EP | 2484455 | A1 | | 8/2012 | |
| EP | 1745940 | B1 | | 12/2013 | |
| EP | 2845732 | A2 | | 3/2015 | |
| EP | 2845732 | B1 | | 3/2017 | |
| WO | 2016/030819 | A1 | | 3/2016 | |
| WO | WO216038572 | | * | 3/2016 | B41F 11/02 |
| WO | WO2016/150867 | | * | 9/2016 | B41F 11/02 |
| WO | 2018/045230 | A1 | | 3/2018 | |

* cited by examiner

DEVICE AND PRINTING PRESS FOR PRODUCING A SECURITY ELEMENT ON A SUBSTRATE

CROSS-REFERENCE TO RELATED APPLICATIONS

This application is the U.S. National Phase, under 35 USC § 371, of PCT/EP2019/076088, filed Sep. 26, 2019; published as WO 2020/094291 A1 on May 14, 2020, and claiming priority to DE 10 2018 127 936.1, filed Nov. 8, 2018, the disclosures of which are expressly incorporated herein in their entireties by reference.

FIELD OF THE INVENTION

The present invention relates to a device and a printing press for producing security elements on a substrate, in particular a security element having a coating medium that contains magnetic or magnetizable particles. The device for producing security elements on a substrate includes a first printing couple, by the use of which first printing couple, a substrate being conveyed along a transport path is or can be printed with a plurality of first print image elements that are spaced apart from one another using a first coating medium that contains magnetic particles. A first magnetic cylinder is located downstream of the first printing couple in the transport path and includes magnetic elements on its outer circumference. A second magnetic cylinder is arranged downstream of the first magnetic cylinder in the transport path and likewise includes magnetic elements on its outer circumference. A drying or curing device is associated with, or is positioned downstream of the second magnetic cylinder in the transport path, by the use of which drying or curing device at least the coating medium of a plurality of second print image elements, printed onto the substrate and spaced apart from one another, is or can be dried or cured at least superficially or at least partially. A printing press, in particular a security printing press, for the in line production of security elements on preferably sheet-format substrate, has a printing material infeed from which the substrate is fed to the printing press for processing.

BACKGROUND OF THE INVENTION

From EP 2 845 732 B1 a printing press is known, which comprises a screen printing unit and a device for aligning magnetic or magnetizable particles contained in the printing ink or the varnish, said device comprising a cylinder that has on its outer circumference a plurality of elements that induce a magnetic field and a dryer directed toward a point in the transport path at which the substrate has not yet left the cylinder.

EP 1 745 940 B1 a two-step coating of an article for security printing in a two-step printing or painting of an article with ink or paint that contains magnetic particles. In a first step, the article is printed/painted with a first ink/dye with a predetermined pattern, then is exposed to a magnetic field, and finally is dried to fix the magnetic particles. In a second step, the article is printed with a magnetic ink or dye, preferably of a lower concentration, then exposed to a magnetic field and dried. In a first embodiment, the second printing/painting is carried out on the same side of the article over the printed image of the first pattern, while in a second embodiment this is carried out on the other side of the article, which in this case is transparent.

In CN 105034570 B, for the production of magnetic printed articles a substrate is printed one or more times with magnetic ink and is then guided over two magnetic drums in succession, where the magnetic ink is oriented in different sub-regions of the printed section by the two magnetic drums. Drying is carried out only after the substrate has passed through the magnetic drums. In first exemplary embodiments, the differently oriented sub-regions are spaced apart from one another, while in one example the sub-regions to be aligned by the two magnetic drums may overlap. Since drying does not take place until after the second alignment, the overlapping section receives orientation from the last magnetic drum. This procedure is intended, on the one hand, to enable more complex magnetic patterns, while at the same time reducing the occurrence of deformations in the substrate, such as those that occur with conventional multiple printing, orientation, and drying.

WO 2016/030819 A1 relates to a combined printing press for a screen printing with magnetically variable ink and subsequent orientation and drying, and subsequent intaglio printing, followed by a screen printing. A very wide range of variants of the embodiments of the invention described therein are claimed to be possible, including the provision of more than one screen printing unit and more than one magnetic unit.

EP 2 484 455 A1 discloses, in one of several exemplary embodiments, a security element having two superimposed printed, oriented, and dried layers of magnetic ink, the first cured coating being produced, i.e. applied, oriented, and cured, after the second cured coating, or vice versa. The steps of application, orientation, and curing may be repeated as desired to produce additional coatings on the substrate and/or the coatings. In another embodiment, in a single pass magnetic ink is printed, and is oriented and dried in one partial region, and is then likewise oriented and dried in another partial region.

US 2011/0017081 A1 discloses a conventional press having two screen printing cylinders that are thrown onto the same impression cylinder, in which case if the two screen printing cylinders print one on top of the other in the same zones, a system for drying the ink printed by the first screen printing cylinder is provided. Various positioning and configuration options for one or more magnetic cylinders are proposed.

DE 10 2016 204 549 A1 relates to a dryer device that can act on the printing material in variable numbers of strips and/or strips of variable width and/or position, in a screen printing unit, a numbering unit, and an offset printing unit, for example. In one embodiment, the screen printing unit comprises two screen printing cylinders, which cooperate with the same impression cylinder and between which a dryer is located. In the transport line located downstream of the screen printing unit a magnetic cylinder can be provided.

EP 2 433 798 A1 discloses a printing press having two screen printing couples with a magnetic cylinder positioned downstream, toward the circumferential surface of which a drying device is directed, and which comprises magnetic elements that are adjustable in the circumferential direction and in the axial direction.

SUMMARY OF THE INVENTION

The object of the present invention is to create a device and a printing press for producing security elements on a substrate.

The object is attained according to the invention by the provision, that in the transport path between the first and the second magnetic cylinder, a second printing couple is provided, by the use of which second printing couple the substrate is or can be printed with the spaced-apart second print image elements using the second coating medium that contains magnetic particles. A second drying or curing device, which is positioned upstream of the second printing couple, is associated with, or is positioned downstream of the first magnetic cylinder in the transport path, by the use of which second drying or curing device, the coating medium containing magnetic particles of the first print image elements, printed by the first printing couple, is or can be dried or cured at least superficially or at least partially. A processing line for processing the substrate includes the first printing couple, by the use of which first printing couple, the substrate can be printed with first print image elements using a first coating medium that contains magnetic particles. A first alignment device is provided, by the use of which first alignment device, particles contained in the first coating medium can be aligned, and a first drying and curing device, by the use of which first drying or curing device, the coating medium of the first print image elements can be dried or cured at least superficially or at least partially. A second printing couple, by the use of which second printing couple the substrate can be printed, is located downstream of the first printing or curing device and is provided with second print image elements, and using a second coating medium that contains magnetic particles. A second alignment device is provided, by the use of which second alignment device, particles contained in the second coating medium can be aligned. A second drying or curing device, by the use of which the coating medium of the second printing element can be dried and cured at least superficially or at least partially, is also provided. A downstream product receiving unit receives the substrate processed in the printing press.

The advantages to be achieved by the invention are, in particular, that substrates having 3a complex, optically variable image elements can be produced in a highly variable manner and/or with high quality and/or precision. In particular, a structure can be produced which, by means of multiple superimposed effective layers, enables image effects or images that change with the viewing angle to be perceived. In particular, specially embodied carrier media that contain the magnetic particles and/or lower particle concentrations in the upper layer, i.e. the layer applied as a second layer or applied to the opposite side of a transparent substrate, enable perceptions of the image of the layer lying immediately above or optionally above the substrate therebeneath to vary dependent on the viewing angle.

By fixing the image from the first layer before another printing is carried out at the same point, uncontrolled mixing of the first and second substances and/or blurred margins can be avoided.

A device for producing security elements according to the invention comprises a first printing couple, by means of which substrate being conveyed along a transport path can be printed with a plurality of first print image elements spaced apart from one another using a first coating medium; a first magnetic cylinder, which is positioned downstream of the first printing couple in the transport path and comprises magnetic elements on its outer circumference; a drying and/or curing device, which is associated with or positioned downstream of the first magnetic cylinder in the transport path and by means of which the coating medium of the first print image elements printed by means of the first printing couple is and/or can be dried and/or cured at least superficially and/or at least each partially, but preferably each in its full extent; a second printing couple, which is positioned downstream of the first magnetic cylinder and the drying and/or curing device; a second magnetic cylinder, which is positioned downstream of the second printing couple in the transport path and likewise comprises magnetic elements on its outer circumference; and a drying and/or curing device, which is associated with or positioned downstream of the second magnetic cylinder in the transport path and by means of which at least the coating medium of the print image elements printed by the second printing couple is and/or can be dried and/or cured at least superficially and/or at least each partially, but preferably each in its full extent. The substrate is conveyed inline between the individual processing stations via corresponding conveying devices.

In the inline production of security elements on a preferably sheet-format substrate, the substrate is first printed with multiple printing elements using a first coating medium that contains magnetic particles; in the transport path downstream, particles contained in the first coating medium applied previously to the substrate are aligned under the influence of magnetic field lines, and after being aligned are at least superficially and/or at least each partially dried and/or cured. The substrate is subsequently printed downstream with second print image elements using a second coating medium that contains magnetic particles, in such a way that the first and second print image elements at least overlap, e.g. in the substrate plane, after which particles contained in the second coating medium applied previously to the substrate are aligned downstream by a renewed influence of magnetic field lines, and finally, the second coating medium is dried and/or cured, at least superficially and/or at least each partially, following the alignment of the particles contained therein.

In a particularly advantageous embodiment, the or at least some of the magnetic elements of the first magnetic cylinder and/or of the second magnetic cylinder are arranged such that they are adjustable individually or in groups with respect to their axial and/or circumferential position on a cylinder main body. This has particular advantages, for example, especially when two optical effects are used in combination, e.g. with respect to the quality and/or variability in the results to be achieved.

Generally independently of the above advantageous embodiment, but advantageously also in combination therewith, in a particularly advantageous embodiment the forme cylinder, in particular the screen printing cylinder, of the first printing couple that applies the first coating medium, and a forme cylinder, in particular a screen printing cylinder, of the second printing couple that applies the second coating medium are driven in rotation, at least in one operating situation, mechanically independently of one another, and are preferably each driven in rotation by a motor, e.g. an electromotive individual drive, which is mechanically independent of the respective cooperating impression cylinder. In this way, for example, a circumferential register between the two corresponding print image elements can be set in a particularly simple manner and/or the forme cylinders, in particular screen printing cylinders, which are driven independently of one another, can be moved to a makeready and/or thrown-off angular position independently of one another.

Generally independently of, but advantageously also in combination with one or more of the above advantageous embodiments, in a particularly advantageous embodiment, particularly a narrow-band radiation dryer, advantageously an LED dryer, in particular a UV-LED dryer, and/or a dryer with which the substrate can be acted on or is acted on with radiation only sectionwise, i.e. in a plurality of spaced-apart sections, as viewed transversely to the direction of transport, is used as a dryer, at least for drying the lower layer or the layer applied in a first printing unit. As a result, heat input is low and material stress and/or deformation is minimized. In addition to or in place of this, in an advantageous embodiment the dryer is dimensioned or is or can be operated in such a way that, in coordination with the exposure time during operation, only a partial drying of the coating medium layer, i.e. of an external partial layer of the coating, is accomplished, and thus the particles that will be perceived in the later security element are essentially fixed in their position.

Generally independently of, but advantageously also in combination with one or more of the above advantageous embodiments, in a particularly advantageous embodiment the at least one printing couple for printing the lower layer is embodied as having a printing forme that is configured to print the substrate over its printing or repetition length with multiple columns, which are spaced apart from one another, in particular equivalently, of print image elements, which are spaced apart from one another, in particular equivalently, transversely to the direction of transport. In particular, the area coverage of the print image applied as the lower layer on the usable area of the substrate, which is determined by the print image length and the print image width, is less than 50%, preferably less than 30%. Magnetic elements on the first and/or second magnetic cylinder are preferably arranged on a cylinder main body such that they can be adjusted individually or in groups with respect to their axial and/or circumferential position.

Generally independently of, but advantageously also in combination with one or more of the above advantageous embodiments, in a particularly advantageous embodiment the first and/or second magnetic cylinder is mounted between frame walls of the press frame in such a way that it can be removed for replacement or to allow makeready work to be carried out, in particular without removing one of the frame walls.

Further details and variants are found in the following exemplary embodiments, which may be combined individually or in groups with one another or with any one of the aforementioned embodiments of the device, the press, and/or the method, provided such combination is not contradicted.

BRIEF DESCRIPTION OF THE DRAWINGS

Exemplary embodiments of the invention are illustrated in the set of drawings and will be described in greater detail in the following.

In the drawings.

DESCRIPTION OF THE PREFERRED EMBODIMENTS

Figure 1:
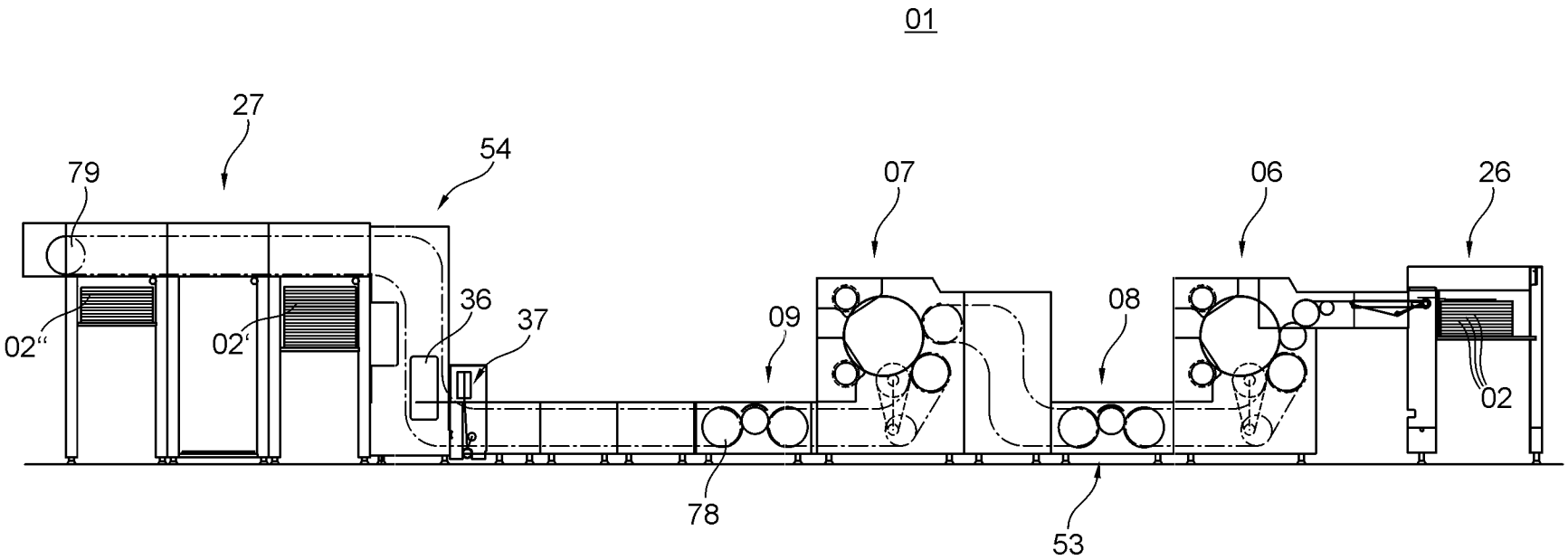
FIG. 1 shows a first exemplary embodiment of a press for producing a security element on a substrate.

A machine 01; 01', e.g. a printing press 01; 01', advantageously a rotary printing press 01; 01', in particular a security printing press 01; 01', for generating optically variable image elements 03, in particular security elements 03, on a substrate 02, e.g. a web-format or sheet-format printing material 02, comprises a first application device 06; 16, e.g. a printing unit 06; 16, by means of which optically variable coating medium 11, e.g. optically variable printing ink 11 or varnish 11, can be applied in the form of first print image elements 12 at at least one application point, e.g. printing nip, to at least a first side of the substrate 02, e.g. the printing material 02, over the entire surface or preferably in partial regions thereof, a second application device 07; 17, e.g. a printing unit 07; 17, by means of which at least a second optically variable coating medium 13, e.g. optically variable printing ink 13 or varnish 13, can be applied in the form of second print image elements 14 at at least one application point, e.g. printing nip, to at least the same first side of the substrate 02, e.g. of the printing material 02, over the entire surface or preferably in partial regions thereof, along with a device 08; 18, arranged in the transport path between the first and second application devices 06; 07; 16; 17, for aligning particles that are contained in the optically variable coating medium 11 applied to the substrate 02 and are responsible for the optical variability, and a device 09; 19, arranged in the transport downstream of the second application device 07; 17, for aligning particles that are contained in the optically variable coating medium 13 applied to the substrate 02 and are responsible for the optical variability. In the following, these devices 08; 18; 09; 19 will also be referred to simply as alignment devices 08; 18; 09; 19.

The printed image elements 12; 14 composed of variable coating medium 11; 13 applied to the substrate 02 by means of the upstream application device 06; 16; 07; 17 prior to treatment by the respective alignment device 08; 18; 09; 19 can correspond in size and position to the optically variable image elements 03 to be produced or can optionally also be smaller or larger than these, optionally even extending over the area of multiple copies 04. In a preferred embodiment, the first and second print image elements 12; 14 are or will be applied to the substrate 02, in particular printed onto the substrate 02, at least partially one on top of the other in such a way that the first and second print image elements 12; 14 at least overlap in pairs, for example such that the first image elements at least do not protrude beyond the second print image elements 12; 14, preferably such that the first and second print image elements 12; 14 are situated one on top of the other and in alignment with one another. In the case of larger print image elements 12; 14, for example, an optically variable image information item, a motif, or a character sequence is not produced by alignment in the optically variable image element 03 over the entire surface area that is coated with optically variable coating medium 11; 13. In the figures, such an image information item is indicated by way of example as a circular disk or spherical cap with a three-dimensional effect that is impressed by magnetic alignment into the print image element 12 beneath it.

Here, as particles that are responsible for optical variability, magnetic or magnetizable, non-spherical particles, e.g. pigment particles, also referred to here simply as magnetic particles or flakes, are contained in the respective coating medium 11; 13, e.g. the printing ink 11; 13 or the varnish 11; 13. Said particles may be provided in the first and the second coating medium 11; 13 in different concentrations and/or color effects in the respective carrier medium.

The press 01; 01' is configured to produce copies 04, e.g. securities 04, in particular banknotes 04, or to produce substrate sheets 02' as intermediate products 02' that are printed with multiple copies 04, e.g. the print images of securities 04, and are processed in the press 01; 01'. The substrate 02, e.g. printing material 02, may be formed, e.g., from cellulose fiber-based or preferably cotton fiber-based paper, plastic polymer, or a hybrid product of these. Before being coated in the aforementioned first application device 06; 16, it may be uncoated or may already have been coated and may be unprinted or may already have been printed one or more times or otherwise mechanically processed. On a substrate section, i.e. a longitudinal section of web-format substrate 02 or a sheet of a sheet-format substrate 02, e.g. substrate sheet 02 or in particular printing material sheet 02, multiple, e.g. three to eight, in particular four to seven, copies 04, e.g. print images 04 of banknotes to be produced, are preferably arranged side by side in a row, and multiple such rows of copies 04 or the print image thereof are preferably arranged, or are to be arranged during the course of processing of the substrate 02, one behind the other in the direction of transport T (e.g. as indicated in FIG. 3 to FIG. 6).

The machine 01; 01' embodied as a printing press 01; 01' can generally comprise two or optionally more printing units 06; 16; 07; 17, each having one or more printing couples 21; 22; 31; 32 for any printing method. In a preferred embodiment, however, it comprises two printing units 06; 16; 07; 17, each having at least one printing couple 21; 22; 31; 32 that operates according to the flexographic printing method or preferably according to the screen printing method, and by means of which the first or second optically variable coating medium 11; 13 is or can be applied, e.g. to the same first side of the printing material 02. By means of the printing methods mentioned, in particular the screen printing method, a greater layer thickness can be applied as compared with other printing methods. The expression "first side" of the substrate 02 or printing material 02 has been chosen arbitrarily and is intended to denote the specific side of the printing material 02 on which the optically variable coating medium 11; 13 is or was or can be applied.

In the case of a transparent substrate 02, the application of the first coating medium 11 to produce the first printed image elements 12 and the application of the second coating medium 13 to produce the second printed image elements 14 can also generally be carried out on two different sides of the substrate 02. A corresponding arrangement of a printing couple 21; 22 of the first printing unit 06; 16 and a printing couple 31; 32 of the second printing unit 07; 17 on different sides of the transport path is to be provided or configured accordingly.

The printing press 01; 01' further comprises at least one printing material infeed 26, e.g. a roll unwinder or preferably a sheet feeder 26, from which the e.g. web-format or preferably sheet-format substrate 02 is or can be fed, optionally via additional printing or processing units, to the first printing unit 06; 16, e.g. flexographic or in particular screen printing unit 06; 16, which applies the optically variable coating medium 11; 13 and has at least one printing couple 21; 22, e.g. flexographic or in particular screen printing couple 21; 22, and downstream of the second printing unit 07; 17, a product receiving unit 27 for receiving the substrate 02 that has been processed or treated in the press 01; 01', e.g. a winder for web-format substrate 02 or a pile delivery 27 in the preferred case of sheet-format substrate 02.

Figure 7:
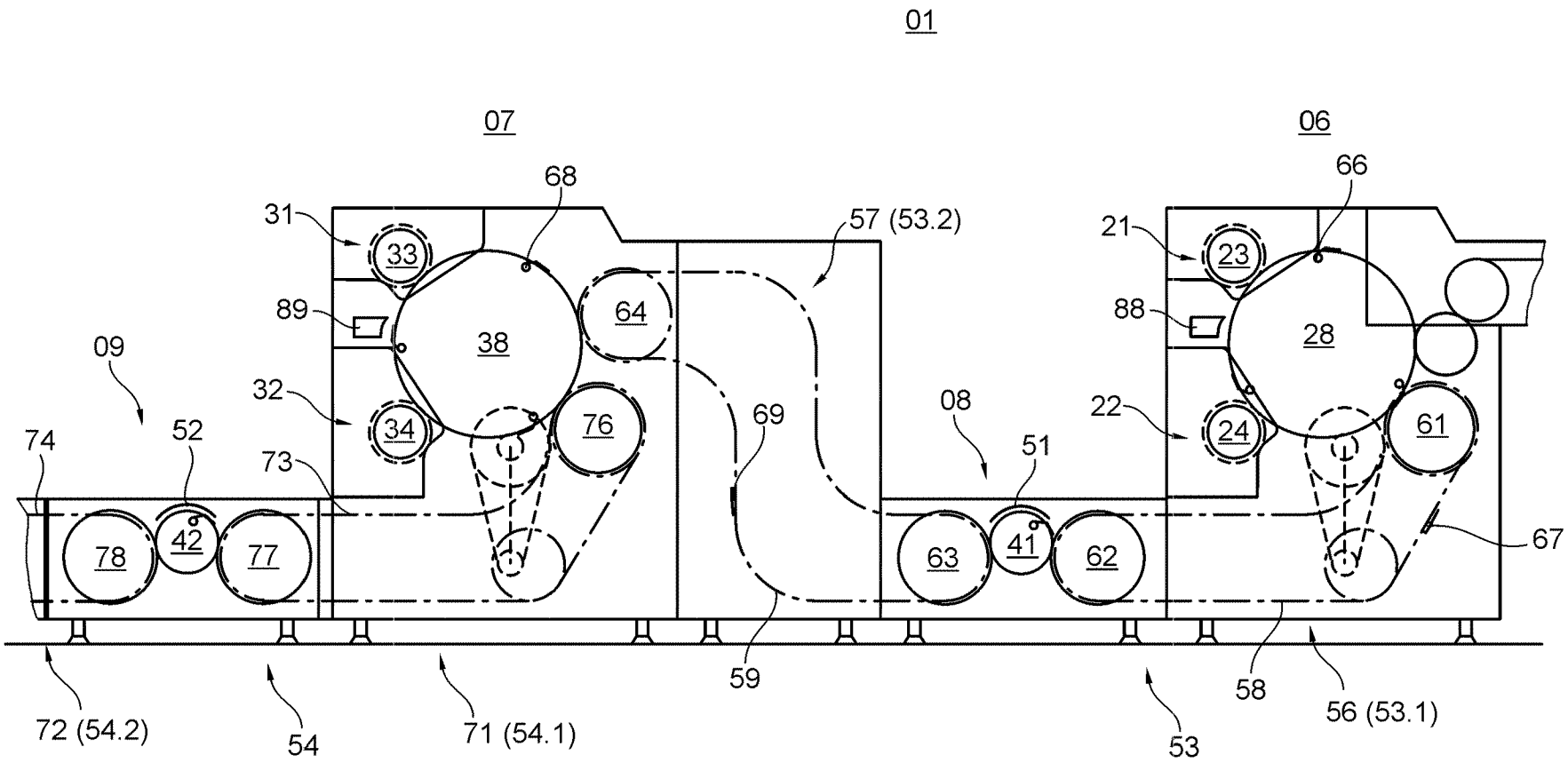
FIG. 7 is an enlarged depiction of the printing units, each followed downstream by an alignment device from FIG. 1.
Figure 8:
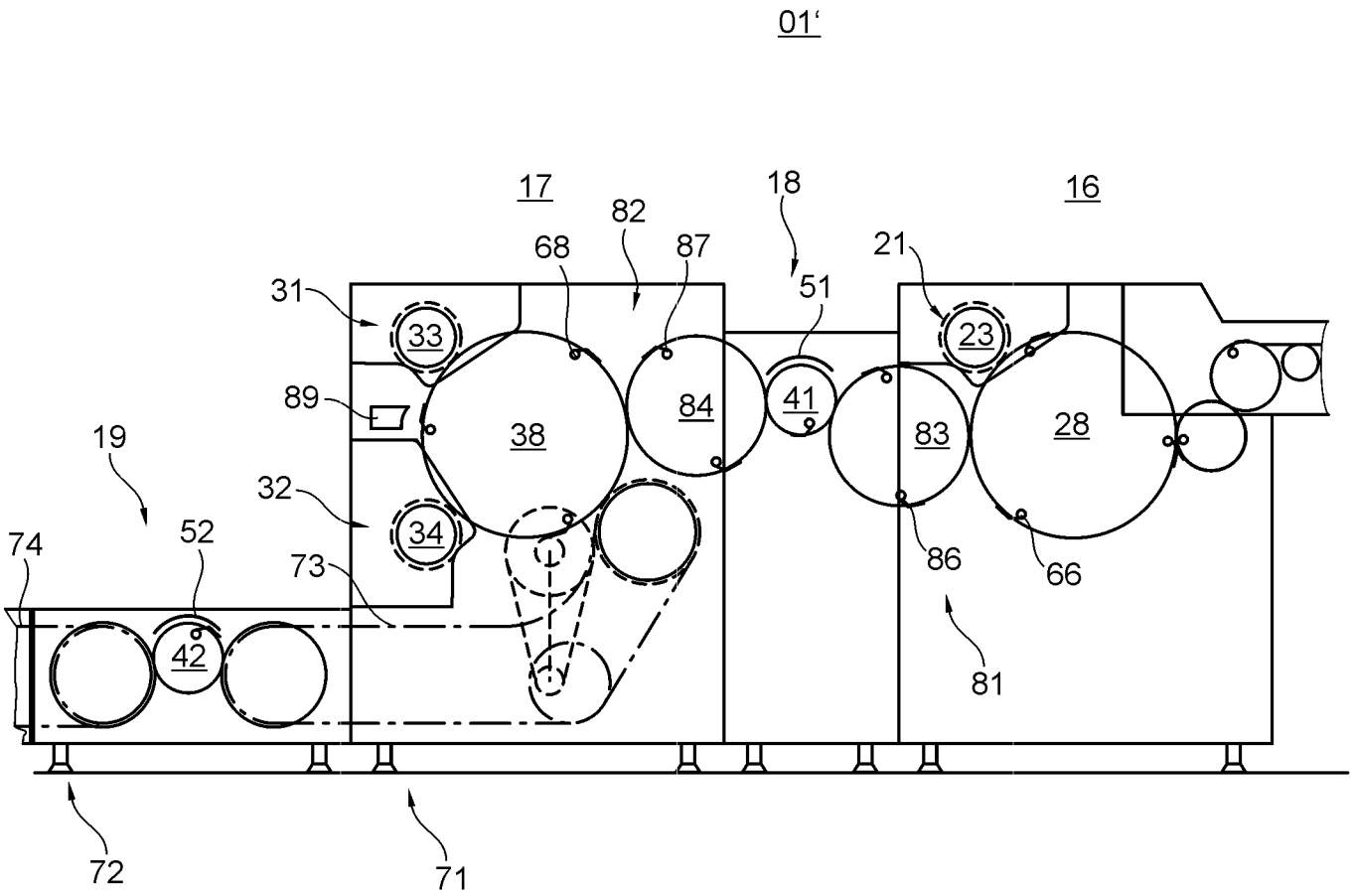
FIG. 8 is an enlarged depiction of the printing units, each followed downstream by an alignment device from FIG. 2.

Although it is possible for only one printing couple 21; 22; 31; 32 to be provided in each printing unit 06; 16; 07; 17, in one advantageous embodiment multiple, in particular two printing couples 31; 32, e.g. flexographic or in particular screen printing couples 31; 32, are provided in at least the second printing unit 07; 17, e.g. flexographic or in particular screen printing unit 07; 17, which form, in each case between a forme cylinder 33; 34, e.g. a screen printing cylinder 33; 34, and an impression cylinder 38, for example a common impression cylinder, two printing nips for the same side of the printing material 02, for example (see, for example, in FIG. 7 and FIG. 8). Preferably, in addition to the second printing couple 31; 32 the at least second printing unit 07; 17 comprises at least one additional printing couple 32; 31. The embodiment as a screen printing couple 31; 32 also enables the coating medium 13 to be applied in a greater layer thickness. Optically variable coating medium 13 may be applicable or applied by only one or—if provided—by two screen printing couples 31; 32 of the second printing unit 07; 17.

As mentioned, the first printing unit 06; 16 can also comprise one or, in an embodiment variant that is advantageous in terms of colorfulness, multiple, in particular two printing couples 21; 22, in particular screen printing couples 21; 22, which form, in each case between a forme cylinder 23; 24, e.g. a screen printing cylinder 23; 24, and an impression cylinder 28, for example a common impression cylinder, two printing nips, e.g. for the same side of the printing material 02 (see also, for example, in FIG. 1 and FIG. 7). In another embodiment variant, the first printing unit 06; 16 can be embodied with only one printing couple 21, in particular screen printing couple 21, which forms a printing nip between a forme cylinder 23, e.g. a screen printing cylinder 23, and a common impression cylinder 28 (see, for example, in FIG. 2 and FIG. 8).

The respective impression cylinder 28; 38 is preferably embodied as triple-sized in circumference, i.e. to accommodate three substrate sheets 02 on its outer circumference.

Figure 9:
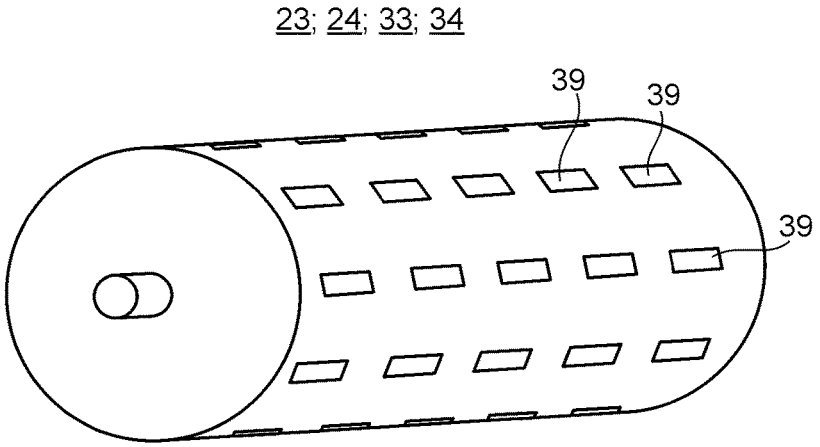
FIG. 9 shows an oblique view of an embodiment of a forme cylinder having on its outer circumference a multiplicity of printing elements provided in rows and columns in the form of a matrix.

The respective printing couple 21; 22; 31; 32 preferably comprises as an image-producing cylinder 23; 24; 33; 34 a forme cylinder 23; 24; 33; 34, which has on its outer circumference a multiplicity of similar and/or identical image-producing elements 39, in particular, e.g. print image motifs, or in particular similar and/or identical groups of image-producing print motifs 39, which are arranged, over a circumferential length that corresponds to the print image length, e.g. in the form of a matrix in multiple columns spaced equidistant from one another transversely to the direction of transport T and, over a cylinder width that corresponds to the print image width, in multiple rows spaced equidistant from one another in the direction of transport T (see, e.g. FIG. 9). In the case of a printing couple 21; 22 that operates by flexographic printing, these elements 39 or print motifs 39 are configured in the form of letterpress relief, and, in the preferred case of a printing couple 31; 32 that operates by screen printing, are configured in the form of screen printing chablons. Said repeating image-producing elements 39 or groups are provided on the outer circumference of the operationally ready image-producing cylinder 23; 24; 33; 34 in the grid of the copies 04 to be printed. Printing in the first printing unit 06; 16 via the image-producing elements 39, preferably using the first coating medium 11, is preferably carried out such that the area coverage of the print image applied as the lower layer, using the first coating medium 11, on the usable surface area of the substrate 02, which is determined by the print image length and print image width, is less than 50%, preferably less than 30%. Thus, a printing forme of the forme cylinder 23; 24 comprises a surface area effective for the transfer of ink, e.g. a raised relief surface or a permeable chablon surface, of less than 50%, in particular less than 30%, based on the usable surface area of the substrate 02 to be printed.

The image-producing elements 39 or optionally groups of image-producing elements 39 arranged in the form of a matrix on a first forme cylinder 23; 24 in at least one first printing couple 21; 22 of the first printing unit 06; 16 and the image-producing elements 39 or groups of image-producing elements 39 on a second forme cylinder 33; 34 in at least one printing couple 31; 32 of the second printing unit 07; 17 are preferably arranged in the same pattern on the respective forme cylinder 23; 24; 33; 34, such that the print image elements 12, printed by the first forme cylinder 23; 24 on the substrate 02, which is being conveyed along the transport path through the press 01; 01', via the image-producing elements 39 or groups, e.g. arranged in the form of a matrix, using the first coating medium 11, and the print image elements 14 or groups of print image elements 14, printed by the second forme cylinder 33; 34 on the substrate 02, which is being conveyed along the transport path to the second printing unit 07; 17, via the image-producing elements 39 or groups of image-producing elements 39, e.g. arranged in the form of a matrix, using the second coating medium 13, at least all overlap, in particular such that the first print image elements do not protrude beyond the second print image elements 12; 14, and preferably such that the first and second print image elements 12; 14 are in alignment with one another. The correct relative axial and angular position with respect to the lateral and circumferential register between the first and second forme cylinder 23; 24, 33; 34 in the transport path is assumed to be given or established.

In an advantageous embodiment, one or the forme cylinder or the forme cylinders 23; 24, in particular screen printing cylinder(s) 23; 24, of the one or more printing couples 21; 22 of the first printing unit 06 and one or the forme cylinder or the forme cylinders 33; 34, in particular screen printing cylinder(s) 33; 34, of one or more printing couples 31; 32 of the second printing unit 07, in at least one operating situation, e.g. at least as part of the making ready, stopping, and/or (re-) starting of the printing couple 21; 22; 31; 32 or the printing press, but preferably also during a production operation, are driven in rotation mechanically independently of one another, preferably each being driven or drivable in rotation by a motor, e.g. an electromotive independent drive, which is mechanically independent of the respective cooperating impression cylinder. Optionally, however, these may be driven independently of one another, but together with the respectively cooperating impression cylinder 28; 38. With this mechanically independent drive, the circumferential register can be set between the two corresponding print image elements in a particularly simple manner, for example, and/or the forme cylinders 23; 24; 33; 34, in particular screen printing cylinders 23; 24; 33; 34, which are driven independently of one another, can be moved toward a makeready and/or idle angular position independently of one another. These individual drives can generally be provided as makeready drives in addition to a separable drive coupling to a main drive that drives multiple components of the respective printing unit 06; 07 or multiple printing units 056; 07 during production operation. In a particularly advantageous embodiment, however, these individual drives are configured and provided to drive the relevant forme cylinders 23; 24; 33; 34 in rotation mechanically independently of one another during production operation as well, and preferably also mechanically independently of the respective impression cylinder 28; 38. Before or during the start-up of the press, at least one of the two independently driven forme cylinders 23; 24; 33; 34, and/or before or during the switching on of one of the printing couples 21; 22; 31; 32, at least the associated forme cylinder 23; 24; 33; 34 is brought to synchronization with a target angular position that is synchronous with the press phase position, i.e. is initially operated at a rotational speed that is lower or higher than the press speed until it reaches the desired or required angular position relative to the press phase position, i.e. relative to the position of the substrate sections being conveyed through the printing press.

The first and second alignment devices 08; 18; 09; 19 each comprise at least one magnetically active cylinder 41; 42, in particular magnetic cylinder 41; 42, lying in the transport path, over which the substrate sheets 02 are guided at least within a rotational angle range of at least 30°, preferably at least 60°, and the magnetic particles of the previously applied and not yet dried coating medium 11; 13 are thereby oriented according to a pattern of magnetic field lines proceeding from the magnetic cylinder 41; 42.

The respective magnetic cylinder 41; 42 has, in the region of its outer circumference, a plurality of elements 43, magnetic elements 43 for short, which induce a magnetic field, and which serve to orient at least some of the magnetic or magnetizable particles of the coating medium 11; 13 applied to the passing printing material 02. The magnetic elements 43 can be formed by permanent magnets with or without engraving, by electromagnets, or by combinations of one or more permanent magnets and/or one or more electromagnets, and in the following will be referred to at times simply as "magnets" 43, regardless of whether a magnetic element 43 is a single magnet or a combination of multiple permanent magnets and/or electromagnets. Said magnets can be arranged on a cylinder main body such that they are removable and/or rotatable about a radially extending axis and/or adjustable individually or in groups with respect to their axial and/or circumferential position, and together with this cylinder main body form the respective magnetic cylinder 41; 42.

In the case of the aforementioned plurality of copies 04 per substrate section or per printing material sheet or substrate sheet 02, multiple rows, e.g. at least four, each containing multiple magnetic elements 43, e.g. three to eight, in particular four to seven, spaced apart from one another transversely to the direction of transport T, are or can be provided circumferentially, e.g. in the form of a matrix, and when rolled off against the substrate 02 being conveyed through the press 01; 01', preferably correspond or coincide with the pattern of printed image elements 12; 14 that are applied to the substrate 02 in the next printing unit 06; 07; 16; 17 upstream and will be exposed to magnetic fields. When the substrate 02 is conveyed over the magnetic cylinder 41; 42, as mentioned above, the particles are aligned or oriented by means of the magnetic field lines produced by the magnetic elements 43, if applicable even through the substrate 02.

The magnets 43 preferably arranged in the form of a matrix on one or on the first magnetic cylinder 41 of the first alignment device 08; 18 and those arranged on one or on the second magnetic cylinder 42 of the second alignment device 09; 19 are arranged on the respective outer circumference in the same pattern, so that the sites of action of the magnets 43 of the first magnetic cylinder 41 and the sites of action of the magnets 43 of the second magnetic cylinder 42 at least all overlap, and preferably are each substantially in alignment with one another. The correct relative axial and angular position with respect to the lateral and circumferential register between the first and the second magnetic cylinder 41; 42 in the transport path is assumed to be given or established.

Figure 10:
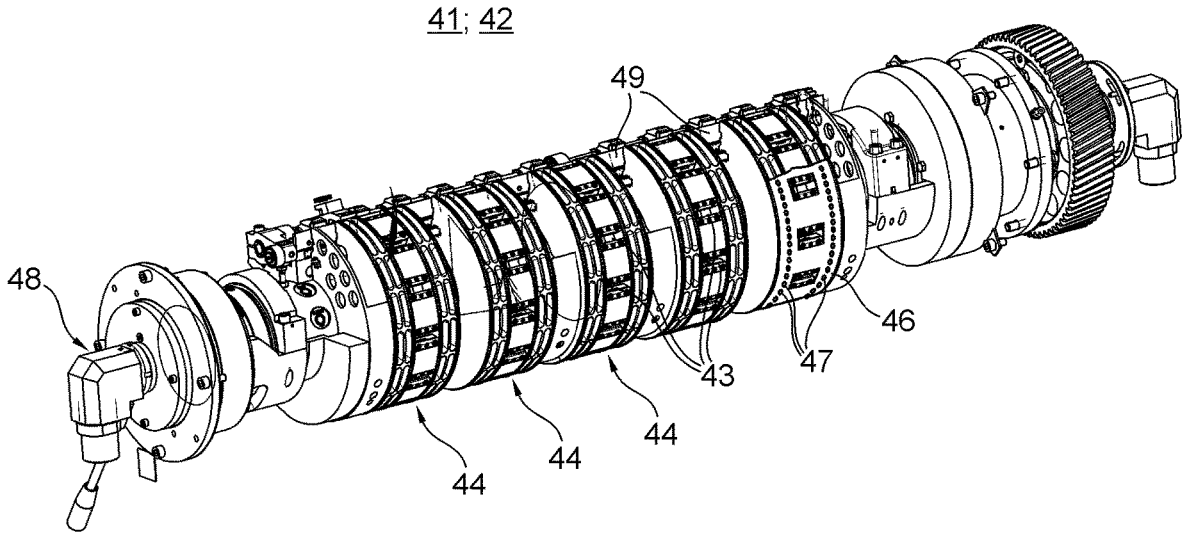
FIG. 10 shows an oblique view of an embodiment of a magnetic cylinder having multiple ring elements, each carrying a plurality of magnets in the circumferential direction.
Figure 11:
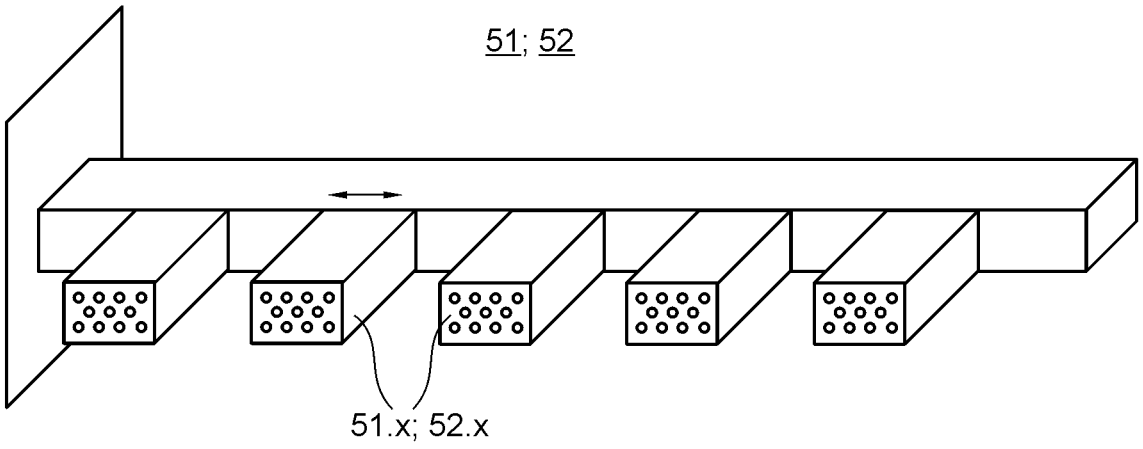
FIG. 11 shows a view obliquely from below of a dryer that acts in a sectionwise manner, in a first embodiment.
Figure 12:
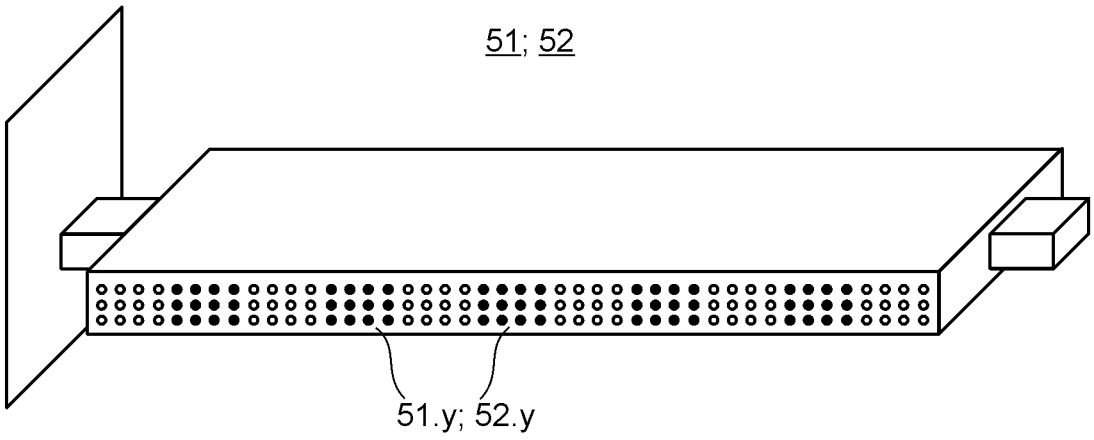
FIG. 12 shows a view obliquely from below of a dryer that acts in a sectionwise manner, in a second embodiment.

The magnetic elements 43 can be arranged or arrangeable—e.g. in accordance with the pattern and the arrangement of the copies 04 or the image-producing elements 39 of a forme cylinder 23; 24; 33; 34 of the closest printing unit 06; 16; 07; 17 upstream—in or on multiple ring elements 44, e.g. in three to eight, in particular in four and seven, which are spaced apart from one another axially and are preferably positionable axially, wherein in or on each of these ring elements 44, at least one, and preferably multiple magnetic elements 43, e.g. between two and twelve, advantageously between five and ten, are or can be arranged one behind the other in the circumferential direction and are preferably positionable in the circumferential direction (see, e.g. FIG. 10). The ring elements 44 are closed in the region of their outer circumference by circumferential coverings 46, for example, e.g. covers 46 connected integrally to the annular ribs, or attached cover plates 46, in which, e.g. suction openings 47 and recesses (not denoted) are provided at the respective locations of the magnetic elements 43 (indicated by way of example for a portion of the ring element 44 on the right in FIG. 10). Alternatively, a cover plate that extends axially over all of the ring elements 44 may be provided, which comprises the recesses and/or suction openings 47 at the relevant points. The suction openings 47, in particular suction channels located beneath said openings, are connected via a line to a vacuum pump. For example, in the magnetic cylinder 41; 42 a line is provided, which extends centrally in the axial direction and at the end face is connected via a rotary union 48 to a vacuum line or vacuum source, and on the cylinder side is connected via line to the suction openings 47 or suction channels.

For use with web-format substrate 02, the magnetic cylinder 41; 42 can be embodied without additional holding means. In the case of sheet-format substrate 02, which is preferred here, holding elements 49, e.g. grippers 49 of what is known as a gripper bar, are preferably provided on the outer circumference of the cylinder 41; 42, by means of which grippers a substrate sheet 02 to be conveyed via the cylinder 41; 42 is or can be picked up at its leading end and held over an angular range during the rotation of the cylinder 41; 42. A magnetic cylinder 41; 42 of this configuration serves at the same time to transport the substrate 02.

In a particularly advantageous embodiment, the first and/or the second magnetic cylinder 41; 42 is mounted between frame walls of the press frame in such a way that it can be removed for replacement or to allow makeready work to be carried out, in particular without removing one of the frame walls. However, this refers to a "planned" or "operational" removal or replacement, as distinguished from a dismantling or disassembly of the relevant structural unit. For this purpose, at least on the drive side, for example, a torsionally rigid releasable connection is provided between magnetic cylinder 41; 42 or cylinder journal and an adjoining drive shaft, the separation point of which lies within the inside width between the frame walls.

The first and second alignment devices 08; 18; 09; 19 each further comprise at least one drying and/or curing device 51; 52, e.g. in particular a narrow-band radiation dryer 51; 52 (e.g. a UV dryer 51; 52), advantageously an LED dryer 51; 52, in particular a UV-LED dryer 51; 52, arranged on the transport path downstream of or preferably in the region of the magnetic cylinder 41; 42. Said dryer is preferably arranged on the transport path such that it is oriented toward the circumferential surface of the at least one magnetic cylinder 41; 42, within an angular range over which the substrate sheet 02 is conveyed by the magnetic cylinder 41; 42. Preferably, the drying and/or curing device 51; 52 acts on a point in the second half of the transport path that extends over the magnetic cylinder 41; 42. To avoid unnecessary heating, the drying and/or curing device 51; 52 embodied as a radiation dryer 51; 52 preferably operates within a narrow-band wavelength range that promotes curing, e.g. within a wavelength band that has a spectral peak width at half height of no more than 50 nm, preferably no more than 30 nm, based on the radiation output. The radiation maximum preferably lies at a wavelength of 385±25 nm, in particular 385±15 nm.

At least the drying and/or curing device 51 associated with the first alignment device 08; 18, but advantageously the drying and/or curing device 51; 52 associated with the two alignment devices 08; 18; 09; 19, is or are preferably embodied and/or configured such that the substrate 02, as viewed transversely to the direction of transport T, is or can be exposed to radiation only in a sectionwise manner, i.e. in multiple sections, e.g. in three to eight, in particular in four to seven, spaced apart from one another, in spaced-apart strips. The position of said strips in the press 01; 01' corresponds with the axial position of the rows, extending in the direction of transport T, of print image elements 12; 14 that have been or will be printed, or corresponds or is aligned with the axial position of the rows of image-producing elements 39 extending in the circumferential direction on the forme cylinder 23; 24; 33; 34, and/or with the axial position of the rows of magnetic elements 43 provided on the associated magnetic cylinder 41; 42.

In one embodiment, this can be accomplished in that the drying and/or curing device 51; 52 embodied as a radiation dryer 51; 52 comprises multiple emitters 51.*x*; 52.*x*, e.g. dryer heads 51.*x*; 52.*x*, spaced apart from one another, for example three to eight, in particular four to seven, each of which may have one individual or a plurality of individual radiation sources, e.g. LED's. Preferably, these dryer heads 51.*x*; 52.*x* or at least some of these dryer heads can be displaced transversely to the direction of transport T and/or can be adjusted in terms of their spacing from one another in or on the alignment devices 08; 18; 09; 19. Depending on the number of columns of copies 04, one or more dryer heads 51.*x*; 52.*x* can thereby be taken out of operation, i.e. deactivated, and moved to a parked position along the side, for example.

In another advantageous embodiment, the substrate 02 can be irradiated in multiple sections that are spaced apart from one another in spaced-apart strips, in that the drying and/or curing device 51; 52 embodied as a radiation dryer 51; 52 comprises a one- or two-dimensional array of radiation sources, e.g. LED's, especially UV-LED's, arranged side by side transversely to the direction of transport T and extending across the printing width, which can be activated via control means in spaced-apart groups 51.*y*; 52.*y* according to the strips that are to be irradiated, while radiation sources that lie between these groups 51.*y*; 52.*y* remain deactivated. The number and/or position and/or width of these groups 51.*y*; 52.*y* can preferably be varied and/or configured via the assigned control means.

The drying and/or curing device 52 associated with the second alignment device 09; 19 can generally also be embodied as having an emitter that emits radiation across the entire width of the substrate and has one or a plurality of radiation sources.

Independently of whether or not sectionwise drying is possible, or advantageously in addition to this, in an advantageous embodiment at least the first alignment device or both of the alignment devices 08; 18; 09; 19 is/are dimensioned or operated or operable in such a way that—adapted to the exposure time during operation—only a partial drying of the coating medium layer, i.e. of an outer partial layer of the previously applied coating medium 11; 13, is accomplished, thereby substantially fixing the particles near the surface, which will be perceived in the later image or security element 03, in their position. A length-specific radiation output in that case is, e.g. no more than 8 kW, in particular no more than 6 kW, per meter of substrate width, i.e. based on one meter of substrate width of the substrate 02 to be treated, the substrate width meaning the extension of the substrate sheet 02 running transversely to the direction of transport T.

Not only, but especially for the embodiment in which the magnetic cylinder 41; 42 can be removed for replacement or to allow makeready work to be carried out, the associated drying and/or curing device 51; 52 can be backed away, e.g. pivoted away, from the magnetic cylinder 41; 42 on a planned basis or operationally, to open up space, in the backed away state, for ready access on the side of the activated drying and/or curing device 51; 52, or, in the case of a planned or operational removal, to clear the path for said removal.

As mentioned above, the first alignment device 08; 18 lies in the transport path on a conveyor line 53 between a printing unit 06; 16 further upstream, designated here as the first printing unit 06; 16, and a printing unit 07; 17 further downstream, designated here as the second printing unit 07; 17, while the second alignment device 09; 19 is arranged in the transport path on a conveyor line 54 downstream of the printing unit 07; 17 further downstream, designated here as the second printing unit 07; 17. This applies generally to all of the aforementioned embodiments and variants of the printing units 06; 16; 07; 17, printing couples 21; 22; 31; 32, alignment devices 08; 18; 09; 19, magnetic cylinders 41; 42 and drying and/or curing devices 51; 52, and independently of the specific configuration of the aforementioned conveyor lines 53; 54, which will be described in greater detail below, but preferably in combination of one or more embodiments and/or variants of the printing units 06; 16; 07; 17 and/or printing couples 21; 22; 31; 32 and/or alignment devices 08; 18; 09; 19 and/or magnetic cylinders 41; 42 and/or drying and/or curing devices 51; 52 and/or configurations of one or both of the conveyor lines 53; 54.

In a first embodiment of the conveyor line 53 lying between the printing units 06; 07 (see, for example, FIG. 1 and FIG. 7), said conveyor line comprises at least one conveyor device 56; 57 based on circulating tractive means 58; 59, embodied as a chain gripper system 56; 57, for example. This system preferably comprises a circulating tractive means 58; 59, e.g. circulating chains 58; 59, on each of the two frame sides, which carry gripper bars 67; 69 extending transversely to the direction of transport T, depicted here at only one point, by way of example. With the gripper bars 67; 69, leading ends of substrate sheets 02 can be gripped at a receiving point, and the substrate sheets 02 can be transported along the transport path and delivered at the target location to the subsequent conveying or receiving means. A sprocket wheel 61; 62; 63; 64, also called a chain gripper wheel, is preferably located at least in the region of the receiving point for the substrate sheet 02, e.g. of a conveying or receiving means of the first printing unit 06, or in the region of the first alignment device 08, with another such sprocket wheel being located in the region where the substrate sheet 02 is delivered to the subsequent conveying or receiving means, e.g. to conveying or receiving means of the first alignment device 08 or to conveying or receiving means of the second printing unit 07.

In a configuration of the first embodiment that is advantageous, e.g. in terms of a modular construction, both in the conveyor line section 53.1 between the first printing unit 06 and the first alignment device 08 and in the conveyor line section 53.2 between the first alignment device 08 and the second printing unit 07, such a conveyor device 56; 57 based on a circulating tractive means 58; 59 is provided. In said configuration, the substrate sheets 02 are received, for example in the region of a first sprocket wheel 61, directly from the impression cylinder 28 of the first printing unit 06 or from holding means 66 provided on its outer circumference by the gripper bars 67 carried along on the tractive means 58; 59, are transported via the circulating tractive means 58; 59 to the first alignment device 08, and are transferred there, in the region of a second chain wheel 62, directly to the sole or the first magnetic cylinder 42 or to the holding means 49 provided on the outer circumference thereof. From the sole or last magnetic cylinder 41 of the first alignment device 08 or from the sprocket wheel 62 thereof, the substrate sheets 02 are received in the region of a third sprocket wheel 63 by gripper bars 69 of the second conveyor device 57; 56 and are transported via the circulating tractive means 59 to the second printing unit 07, where they are transferred in the region of a fourth sprocket wheel 64, optionally to an upstream transport cylinder, but preferably directly to the impression cylinder 38 of the second printing unit 07 or to holding means 68 provided in the region of the outer circumference of said cylinder.

In conjunction with this first embodiment of the first conveyor line 53, the first and second printing units 06; 07 each comprise two printing couples 23; 24; 33, 34.

The second conveyor line 54 can generally be configured in a first and/or a second conveyor line section 54.1; 54.2 as based on a successive transfer between cylinders and drums. In the embodiment presented here, however, said conveyor line 54 is also embodied as having at least one conveyor device 71; 72 based on circulating tractive means 73; 74, in particular chains 73; 74, and comprising sprocket wheels 76; 77; 78; 79 on the receiving and transferring sides, as described above, along with gripper bars (not shown here).

Preferably, both in the conveyor line section 54.1 between the second printing unit 07 and the second alignment device 09 and in the conveyor line section 54.2 between the second alignment device 09 and the product receiving unit 27, such a conveyor device 71; 72 based on tractive means 73; 74 is provided. The above applies accordingly to the transport from the second printing unit 07 to the alignment device 09 and from there to the product receiving unit 27 via the respective sprocket wheels 76; 77; 78; 79 and holding means 49 likewise provided on the magnetic cylinder 42 of the second alignment device 09, with the difference that, at the end of the second conveyor line section 54.2, the substrate sheets 02 are deposited on a pile upstream of the sprocket wheel 79 at the end, for example, or are delivered to a transport cylinder, e.g. a cooling cylinder or an inspection cylinder, on the intake side of the product receiving unit 27.

Figure 2:
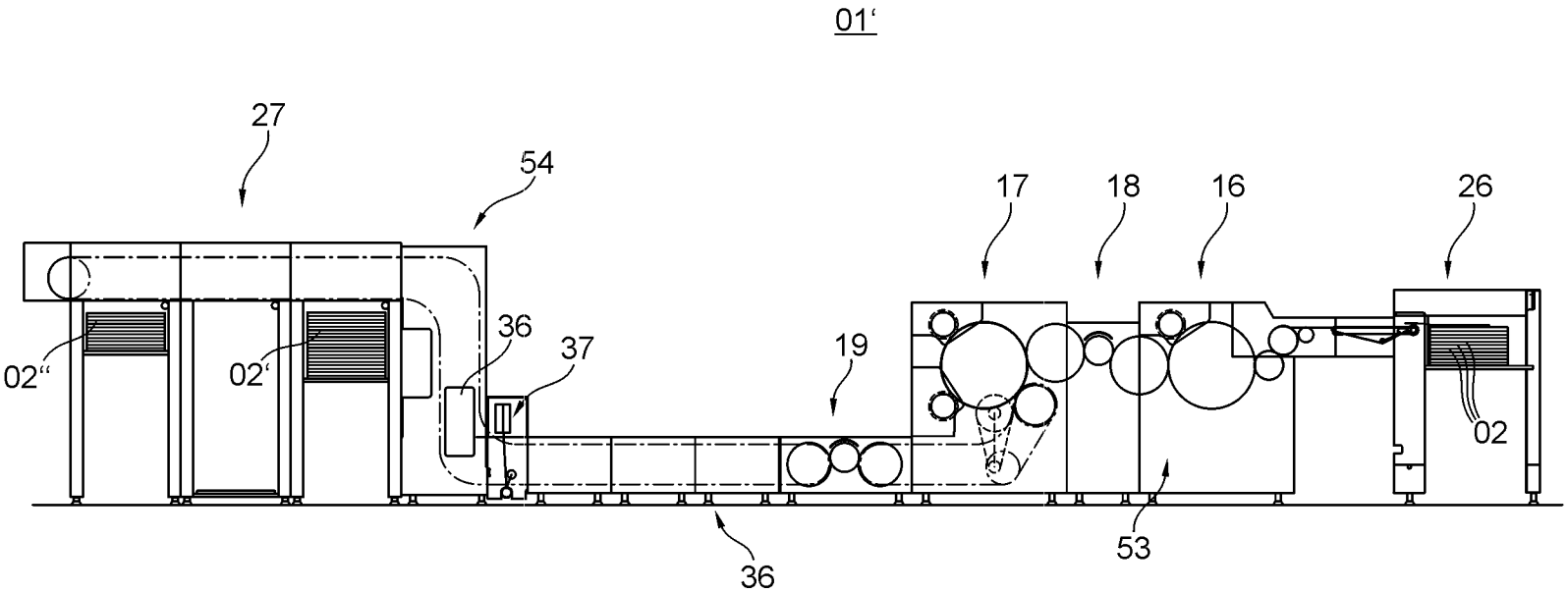
FIG. 2 shows a second exemplary embodiment of a press for producing a security element on a substrate.
Figure 3:
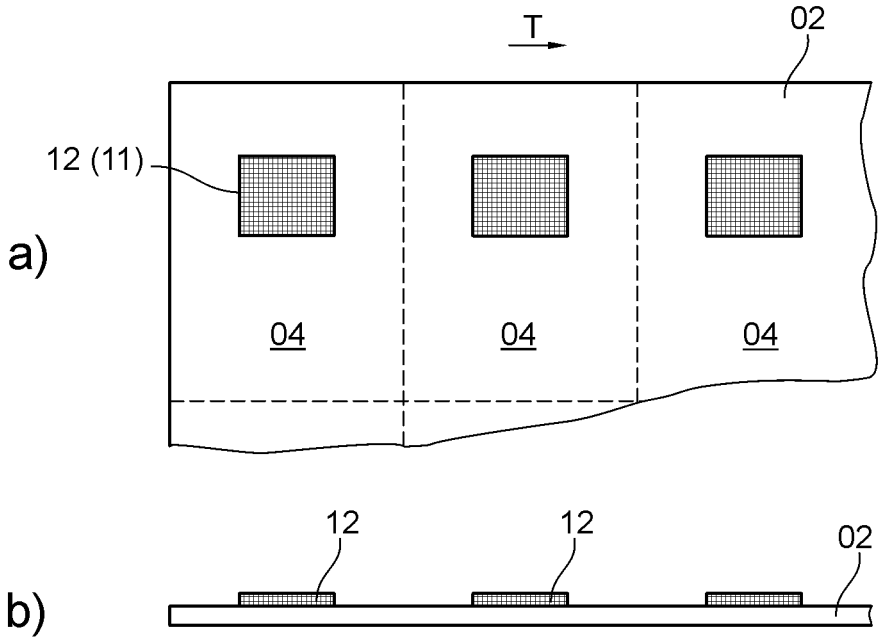
FIG. 3 is a schematic depiction of a substrate printed in first print image elements with a first optically variable coating medium a) in a plan view and b) in cross section.
Figure 4:
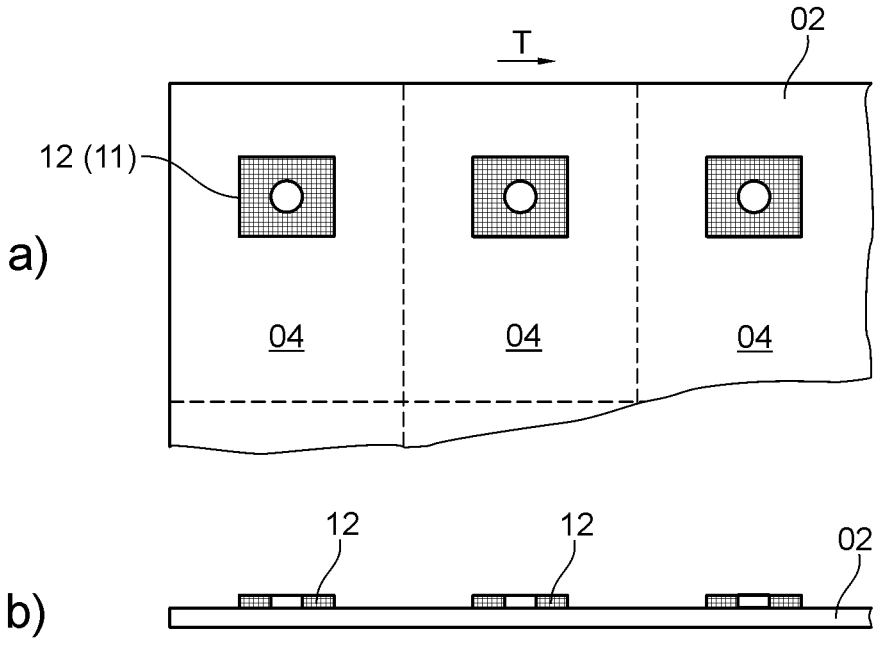
FIG. 4 is a schematic depiction of the substrate printed with first print image elements from FIG. 3 following an at least partial magnetic alignment to a first image content that is perceivable a) in a plan view and b) in cross section.
Figure 5:
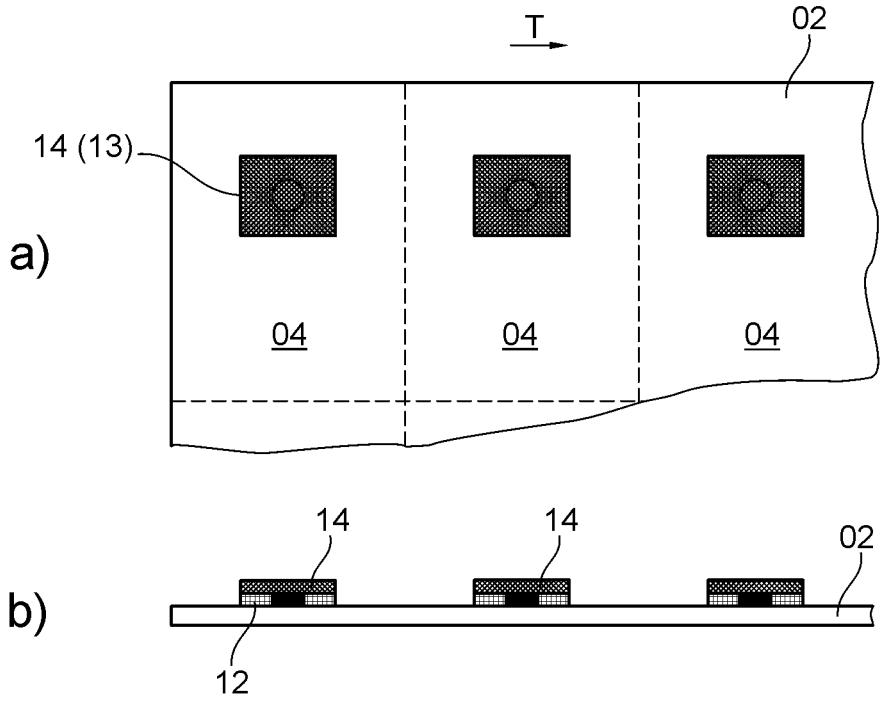
FIG. 5 is a schematic depiction of the substrate from FIG. 3 with second print image elements printed over the first print image elements using a second optically variable coating medium a) in a plan view and b) in cross section.
Figure 6:
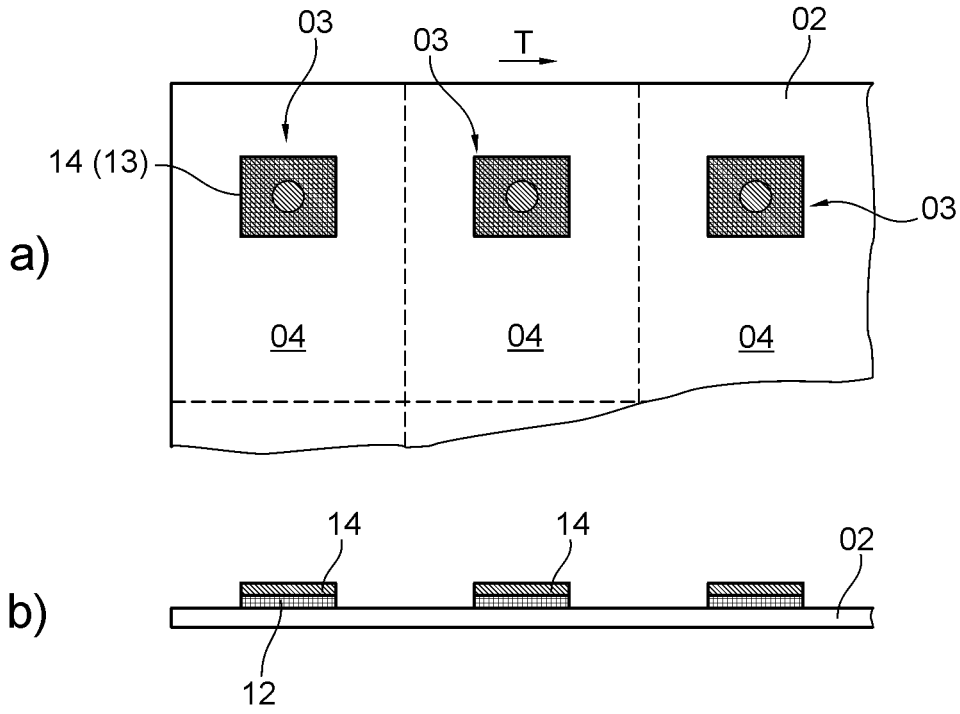
FIG. 6 is a schematic depiction of the security element after coating with the second coating medium and an at least partial alignment of the magnetic or magnetizable particles of the second print image elements a) in a plan view and b) in cross section.

In a second embodiment of the first conveyor line section 53 between the two printing units 16; 17, in at least one, and preferably in both of the conveyor line sections 53.1; 53.2 a conveyor device 81; 82 based on a successive transfer between transport cylinders and/or drums is provided (see, e.g., FIG. 2 and FIG. 8).

For this purpose, at least one rotating transport body 83; 84, e.g. cylinder or drum 83; 84, in particular transport cylinder or drum 83; 84, with respective holding means 86; 87 on its outer circumference, e.g. gripper strips 86; 87, is provided in each case between the impression cylinder 28 of the first printing unit 16 and the first or sole magnetic cylinder 41 of the first alignment device 18 and between the last or sole magnetic cylinder 41 of the first alignment device 18 and the second printing unit 17. Advantageously this is an uneven number in each case, preferably precisely one transport body 83; 84 in each case.

The substrate sheets 02 then are transferred, e.g. from the impression cylinder 28 of the first printing unit 16—which cylinder is preferably triple-sized and comprises three holding means 66 on its outer circumference—or from holding means 66 provided on the outer circumference of said cylinder to holding means 86 of a rotating transport body 83 located immediately downstream, and from there is transferred, e.g. indirectly via additional transport elements or preferably directly, to the sole or first magnetic cylinder 42 or to holding means 49 provided on the outer circumference thereof. After traveling around the magnetic cylinder or cylinders 41 of the first alignment device 18, the substrate sheets 02 are transferred, e.g. from the last or sole magnetic cylinder 41 of the first alignment device 18—which cylinder is preferably single-sized and comprises one holding means 49 on its outer circumference—or from the holding means 49 provided on the outer circumference of said cylinder to holding means 87 of a rotating transport body 84 located immediately downstream, and from there are transferred, e.g. indirectly via additional transport elements or preferably directly to the impression cylinder 38 of the second printing unit 17—which is preferably triple-sized and comprises three holding means 68 on its outer circumference—or to holding means 68 provided on the outer circumference thereof (see, e.g., FIG. 2 and FIG. 8).

In a preferred embodiment, only one, but preferably a double-sized transport body 83; 84, e.g. in the form of a transport cylinder 83; 84 or transport drum 83; 84, is provided on each of the two sides of the first alignment device 18 as a conveyor 71; 72.

The conveyor line 54 located downstream of the second printing unit 17 and containing the second alignment device 19 can generally likewise be configured based on a transfer between cylinders and drums on both sides of the alignment device 19, or, as described in the example above, may comprise two conveyor devices 71; 72 based on circulating tractive means 73; 74 (see, e.g. FIG. 2 and FIG. 8).

In conjunction with this second embodiment of the first conveyor line 53, the first printing unit 16 comprises only one printing couple 23, for example.

In a modification of the aforementioned embodiment of the first and/or second conveyor lines 53; 54 based on circulating tractive means 58; 59; 73; 74, which modification is advantageous in terms of the number of sheet transfers, for example, the two conveyor line sections 53.1; 53.2; 54.1; 54.2 of these conveyor lines 53; 54 may be embodied as only one continuous conveyor device 56; 71 based on circulating tractive means 58; 59; 73; 74, with the magnetic cylinder or cylinders 41; 42 of each relevant alignment device 08; 18; 09; 19 being formed, e.g. with associated sprocket wheels at its end faces for guiding the tractive means 58; 59; 73; 74, and/or with axially extending recesses for immersion of the gripper bars.

In further embodiments for the configuration of the conveyor lines 53; 54 not explicitly described here, mixed variants could generally also be provided for specific requirement profiles: For instance, in one modification the first or second conveyor line section 53.1; 53.2 of the first conveyor line 53 could be implemented as a conveyor device based on a circulating tractive means, as described in the first exemplary embodiment, while the other is embodied as a conveyor device based on successive transfers between rotating transport bodies 83; 84, as described in the second exemplary embodiment. Likewise, the first or second conveyor line section 54.1; 54.2 of the second conveyor line 54 can be implemented as a conveyor device based on a circulating tractive means, as described in the first exemplary embodiment, while the other is embodied as a conveyor device based on successive transfers between rotating transport bodies 83; 84, as described in the second exemplary embodiment. The first or the second conveyor line 53; 54 may also be embodied in the manner described above with one continuous conveyor device 56; 71 over both conveyor line sections 53.1; 53.2; 54.1; 54.2, while the other of the two conveyor lines 53; 54 may be configured as divided in a manner mentioned above, with both based on tractive means or on transport bodies or mixed.

If two printing couples 23; 24; 33; 34 are provided in one printing unit 06; 16; 07; 17, then in an advantageous refinement a drying and/or curing device 88; 89, e.g. in particular a narrow-band radiation dryer 88; 89 (e.g., UV dryer 88; 89), advantageously an LED dryer 88; 89, in particular a UV-LED dryer 88; 89, may be provided in the transport path between the two printing nips of the relevant printing unit 06; 16; 07; 17, directed toward the first side of a printing material 02 to be conveyed through the printing unit 04.

In a likewise advantageous refinement of the printing press 01; 01', a drying and/or curing device 36, e.g. a radiation dryer 36, in particular a UV dryer 36, that acts continuously across the entire substrate width for a thorough drying of the coating medium 11; 13 applied to the substrate 02 is provided downstream of the second alignment device 09; 19.

Particularly in conjunction with a pile delivery 27 that comprises multiple pile spaces, in an advantageous refinement an inspection device 37 is provided downstream of the second alignment device 09; 19 in the transport path; said inspection device operates, e.g. by the incident light method and comprises a light source oriented toward the transport path, along with a camera aimed at the point of incidence in the transport path. Substrate sheets 02" that are considered to be defective or as containing a faulty printed image can then be collected as scrap 02" on one of the piles, while so-called good sheets are deposited on another pile.

While preferred embodiments of a device and of a printing press for producing a security element on a substrate, in accordance with the present invention, have been set forth fully and completely hereinabove, it will be apparent to one of skill in the art that various changes could be made thereto, without departing from the true spirit and scope of the present invention, which is accordingly to be limited only by the appended claims.

The invention claimed is:

1. A device for producing security elements (03) on a substrate (02), the device having a first printing unit having at least one first printing couple (21; 22), by means of which substrate (02) being conveyed along a transport path is and/or can be printed with a plurality of first print image elements (12) that are spaced apart from one another using a first coating medium (11) that contains magnetic particles, a second printing unit having at least one second printing couple (31; 32), by means of which the substrate (02) is and/or can be printed with second print image elements (14; 12) that are spaced apart from one another using a second coating medium (13) that contains magnetic particles, a first magnetic cylinder (41), arranged downstream of the first printing unit (21; 22) in the transport path, which comprises magnetic elements (43) on its outer circumference for the alignment of magnetic particles, a first drying and/or curing device (51) associated with or positioned downstream of the first magnetic cylinder (41) in the transport path, by means of which device the coating medium (11) containing magnetic particles of the first print image elements (12), printed by the at least one first printing couple (21; 22), is or can be dried and/or cured at least superficially and/or at least each partially, a second magnetic cylinder, arranged downstream of the second printing unit (41) in the transport path, which likewise comprises magnetic elements (43) for the alignment of magnetic particles, and a second drying and/or curing device (52), means for adjusting the magnetic elements (43) of at least one of the first magnetic cylinder (41) and those of the second magnetic cylinder (42), which magnetic elements are each arranged on a cylinder main body of a respective one of the first and second magnetic cylinders such that the magnetic elements can be adjusted one of individually and in groups with respect to their axial and/or circumferential position on their respective one of the first and second magnetic cylinders, wherein the second drying and/or curing device (52) is associated with or positioned downstream of the second magnetic cylinder (42) in the transport path, in that by means of the second drying and/or curing device (52) at least the coating medium (13) of the plurality of second print image elements (14), printed onto the substrate (02) and spaced apart from one another, is dried and/or cured at least partially, in that the second printing unit having the at least one second printing couple (31; 32) is provided between the first and the second magnetic cylinder (41; 42) in the transport path, and in that the first and/or the second drying and/or curing device (51; 52) is embodied to act on substrate (02) that is being conveyed along the transport path, in multiple strips that are spaced at variable distances from one another axially.

2. The device according to claim 1, characterized in that the drying and/or curing device (51; 52) associated with or positioned downstream of the first and/or the second magnetic cylinder (41; 42) is configured to expose substrate (02) being conveyed past it to radiation in a sectionwise manner, as viewed transversely to the direction of transport (T), i.e. in multiple strips spaced apart from one another.

3. The device according to claim 1, characterized in that the drying and/or curing device (51; 52) associated with or positioned downstream of the first magnetic cylinder (41; 42) and/or the drying and/or curing device associated with or positioned downstream of the second magnetic cylinder is arranged on the transport path in such a way that its action is oriented toward the circumferential surface of the relevant magnetic cylinder (41; 42) in an angular range over which the substrate sheet (02) is being conveyed lying on the magnetic cylinder (41; 42).

4. The device according to claim 1, characterized in that image-producing elements (39) or groups of image-producing elements (39) on the outer circumference of a forme cylinder (23; 24) of the at least one first printing couple (21; 22) and image-producing elements (39) or groups of image-producing elements (39) on the outer circumference of a forme cylinder (33; 34) of the at least one second printing couple (31; 32) are arranged on the respective forme cylinder (23; 24; 33; 34) in the same pattern, so that the print image elements (12) or groups of print image elements (12) printed by the at least one first printing couple (21; 22) using the first coating medium (11) and the print image elements (14) or groups of print image elements (14) printed downstream by the at least one second printing couple (31; 32) using the second coating medium (13) all at least overlap in pairs.

5. The device according to claim 1, characterized in that a forme cylinder (23; 24) of the at least one first printing couple (21; 22) and/or a forme cylinder (33; 34) of the at least one second printing couple (31; 32) comprises, on its outer circumference, image-producing elements (39) or groups of image-producing elements (39) arranged in the form of a matrix in multiple rows extending axially and multiple columns extending in the circumferential direction.

6. The device according to claim 4, characterized in that the first magnetic cylinder (41) has a pattern of magnetic elements (43) on its outer circumference that corresponds to the pattern of the image-producing elements (39) or groups of image-producing elements (39) of the forme cylinder (23; 24) of the at least one first printing couple (21; 22), and/or the second magnetic cylinder (42) has a pattern of magnetic elements (43) on its outer circumference that corresponds to the pattern of image-producing elements (39) or groups of image-producing elements (39) of the forme cylinder (33; 34) of the at least one second printing couple (31; 32).

7. The device according to claim 2, characterized in that the spaced-apart active strips of the drying and/or curing device (51; 52) that acts in a sectionwise manner correspond in terms of their axial position with columns of image-producing elements (39) or groups of image-producing elements (39) extending on the forme cylinder (23; 24; 33; 34) in the circumferential direction and/or correspond with the number of copies (04) to be produced on the substrate (02) transversely to the direction of transport.

8. The device according to claim 1, characterized in that the at least one first printing couple (21; 22) and the at least one second printing couple (31; 32) are coupled to one another via a first conveyor line (53) that transports the substrate (02) in the form of individual substrate sheets (02) and guides them over the first magnetic cylinder (41).

9. The device according to claim 1, characterized in that the respective at least one first printing couple and the at least one second printing couple (21; 22; 31; 32) of the first printing unit and the second printing unit each comprises, as an image-producing cylinder (23; 24; 33; 34), a forme cylinder (23; 24; 33; 34) having a multiplicity of image-producing elements (39) or groups of image-producing elements (39) on its outer circumference, which are arranged in the form of a matrix of multiple columns spaced equidistant from one another transversely to the direction of transport (T), over a circumferential length that corresponds to the print image length, and multiple rows spaced equidistant from one another in the direction of transport (T) across a cylinder width that corresponds to the print image width, wherein the image-producing elements (39) or groups of image-producing elements (39) arranged in the form of a matrix are arranged on a first forme cylinder (23; 24) in the at least one first printing couple (21; 22) of the first printing unit (06; 16), and the image-producing elements (39) or groups of image-producing elements (39) are arranged on a second forme cylinder (33; 34) in the at least one second printing couple (31; 32) of the second printing unit (07; 17) on the respective forme cylinder (23; 24; 33; 34) in the same pattern, such that the print image elements (12) printed by the at least one first forme cylinder (23; 24), using the first coating medium (11) via the image-producing elements (39) or groups arranged in the form of a matrix, on the substrate (02) being conveyed along the transport path through the press (01; 01'), and the print image elements (14) or groups of print image elements (14) printed by the at least one second forme cylinder (33; 34), using the second coating medium (13) via the image-producing elements (39) or groups of image-producing elements arranged in the form of a matrix, on the substrate (02) being conveyed along the transport path to the second printing unit (07; 17) at least all overlap.

10. The device according to claim 1, characterized in that the first and/or second magnetic cylinder (41; 42) is mounted between frame walls of the press frame in such a way that it can be removed on a planned basis for replacement or to allow makeready work to be carried out.

11. A printing press (01; 01') for the inline production of security elements (03) on substrate (02), the printing press having a printing material infeed (26), from which the substrate (02) is fed into the printing press (01; 01') for processing, a device that forms a processing line for processing the substrate (02), comprising a first printing unit having at least one first printing couple (21; 22), by means of which substrate (02) being conveyed along a transport path can be printed with a plurality of first print image elements (12) that are spaced apart from one another using a first coating medium (11) that contains magnetic particles, a first alignment device (08; 18), configured as a first magnetic cylinder (41) and arranged downstream of the first printing unit (21; 22) in the transport path, and comprising on its outer circumference magnetic elements (43), by means of which particles contained in the first coating medium (11) can be aligned, a first drying and/or curing device (51), associated with or positioned downstream of the first magnetic cylinder (41) in the transport path, by means of which the coating medium (11) that contains magnetic particles of the first print image elements (12) printed by the at least one first printing couple (21; 22) can be dried and/or cured at least superficially and/or at least each partially, a second printing unit having at least one second printing couple (31; 32), by means of which the substrate (02) can be printed, downstream of the first drying and/or curing device (51), with second print image elements (14) that are spaced apart from one another, using a second coating medium (13) that contains magnetic particles, a second alignment device (09; 19) configured as a second magnetic cylinder (42), which likewise comprises magnetic elements (43), a second drying and/or curing device (52), means for adjusting the magnetic elements (43) of at least one of the the first magnetic cylinder (41) and those of the second magnetic cylinder (42), which magnetic elements are each arranged on a cylinder main body of a respective one of the first and second magnetic cylinders such that the magnetic elements can be adjusted individually or in groups with respect to their axial and/or circumferential position on their respective one of the first and second magnetic cylinders, and a product receiving unit (27) downstream for receiving the substrate (02) processed in the printing press, characterized in that the second printing unit (31; 32) is positioned downstream of the first drying and/or curing device (51), in that particles contained in the second coating medium (13) can be aligned by means of the second magnetic cylinder (42), in that the second drying and/or curing device (52) is associated with or positioned downstream of the second magnetic cylinder (42) in the transport path and in that at least the coating medium (13) of the second print image elements (14) can be dried and/or cured at least partially by means of said device, and in that the first and/or the second drying and/or curing device (51; 52) is embodied to act on substrate (02) that is being conveyed along the transport path in multiple strips spaced at variable distances from one another axially.

12. The printing press according to claim 11, characterized in that between the second alignment device (09; 19) and the product receiving unit (27) an inspection device (37) directed toward the transport path and/or an additional drying and/or curing device (36) and/or a conveyor device (71; 72) based on circulating tractive means (73; 74) is provided, and that at least the second printing unit (07; 17) comprises at least one further printing couple (32; 31) in addition to the at least one second printing couple (31; 32).

13. The printing press according to claim 11, characterized in that the first and second printing units (21; 22; 31; 32) are configured to print substrate sheets (02) with a variable number and/or length of rows of copies (04) to be printed, arranged side by side, said rows running transversely to the direction of transport (T), and/or with a variable number and/or width of columns of copies (04) to be printed, arranged one behind the other, said columns running in the direction of transport (T).

14. The printing press according to claim 11, characterized in that a forme cylinder (23; 24) of the at least one first printing couple (21; 22) that applies the first coating medium and a forme cylinder (33; 34) of the at least one second printing couple (31, 32) that applies the second coating medium are or can be driven in rotation mechanically independently of one another in at least one operating situation.

15. The printing press according to claim 11, characterized by the embodiment of the printing press as a sheet-fed printing press and/or for the inline production of security elements (03) on sheet-format substrate (02).

* * * * *